US006968582B1

(12) United States Patent
Barton et al.

(10) Patent No.: US 6,968,582 B1
(45) Date of Patent: Nov. 29, 2005

(54) EXPANDABLE TOP BEDDING

(76) Inventors: Stephen C. Barton, 4295 Three Bridge Rd., Powhatan, VA (US) 23139; James D. Slaughter, 2487 Tye River Rd., Amherst, VA (US) 24521; Charles R. Jordan, 120 Buckingham Rd., Charlottesville, VA (US) 22903

( * ) Notice: Subject to any disclaimer, the term of this patent is extended or adjusted under 35 U.S.C. 154(b) by 0 days.

(21) Appl. No.: 10/833,818

(22) Filed: Apr. 28, 2004

(51) Int. Cl.[7] ..... A47G 9/02
(52) U.S. Cl. ..... 5/486; 5/495; 5/496
(58) Field of Search ..... 5/482, 486, 495–496

(56) References Cited

U.S. PATENT DOCUMENTS 768,119 A 8/1904 Fine
3,377,636 A 4/1968 Di Addario
4,304,018 A 12/1981 McClam
4,903,360 A 2/1990 Friedman
6,341,396 B1 * 1/2002 Carapezza ..... 5/482

* cited by examiner

*Primary Examiner*—Heather Shackelford
*Assistant Examiner*—Fredrick Conley
(74) *Attorney, Agent, or Firm*—Denis O'Brien, Esq.

(57) ABSTRACT

The present invention provides top-bedding that has a head-end delimited by a head-end edge; a foot-end opposite the head-end, the foot-end delimited by a foot-end edge substantially parallel to the head-end edge; at least one pair of opposing sides delimited by side-edges; a first head-end corner and a second head-end corner; and a reversible expansion means for reversibly converting the top-bedding from a closed configuration to an open configuration, the closed configuration being approximately rectangular, and the open configuration having the shape of an irregular, simple polygon, whereby the distance between the first head-end corner and the second head-end corner is greater when the top-bedding is in the open configuration than when it is in the closed configuration.

12 Claims, 2 Drawing Sheets

EXPANDABLE TOP BEDDING

BACKGROUND OF THE INVENTION

1. Field of the Invention

The field of the invention is top-bedding, defined herein as bedding of the kind that is placed over sleeping persons, including, by way of example, sheets, blankets, covers, duvets, quilts and the like, and more specifically, the field of the invention is top-bedding that is capable of reversibly expanding to accommodate the person or persons using the top-bedding.

2. Statement of the Problems Solved by the Invention

One of the most perennial and universal struggles in the battle of the sexes is the nightly conflict over covers. For centuries, if not millennia, couples sharing a bed have waged somniferous, often unconscious, wars with each other over control of the covers. Particularly in colder climates and during colder months, an unequal distribution of covers, and hence warmth, can adversely affect both the quality and quantity of sleep for the party who is unable to wrestle a fair share of the covers away from their sleeping partner. The consequential lost sleep has obvious ramifications for the ability to function optimally during waking hours.

Most of this nocturnal grappling over covers occurs at the head end of the bed where the body-surface areas and body-volumes of the sleepers are greatest relative to bedding surface area. In addition, the movements of the feet during sleep are generally less spirited than the movements of the torso and arms. Consequently, the focal point of the struggle for covers is typically at the head-end of the bed, and it is there that a greater surface area of top-bedding would be beneficial to both sleepers.

Another aspect of the problem is that while persons are sleeping, it is normally desirable that the edges of the top-bedding along both sides and along the foot of the bed remain tucked in to prevent chilling drafts from wafting to and fro underneath the bedding. However, if the bedding is too taut, it is easily pulled loose along the sides and/or foot of the bed during the eight-hour roll and tumble of a night's sleep. Consequently, one or both users suffer loss of quality sleep because of the resulting drafts.

The aesthetic norms for a well made bed-which commonly dictate that the bedding be tightly secured to the bed by the frictional forces of tucking and be free of wrinkles—only exacerbate these problems because a cover or sheet that has ample surface area to accommodate two sleepers is almost certainly too bulky and voluminous to be secured tightly across the surface of the bed without out producing unsightly wrinkles and lumps when the bed is made.

What is needed is expandable top-bedding that has a closed configuration that is amenable to being affixed to a bed in a neat and taut manner and yet easily and reversibly converts to an open configuration that accommodates sleeping partners and provides ample covering for each, thereby obviating the need to compete for covers.

3. Related Art

A number of partial solutions to the foregoing problems have been patented. The general approach has been to combine a greater surface area of top-bedding with a means of folding the top-bedding in a way that allows it to conform to the aesthetic norms of a made bed.

U.S. Pat. No. 3,377,636 to Alexander DiAddario is an example of this approach. DiAddario provides top-bedding with guidelines inscribed thereon and with wing-panels. The guidelines assist in folding the bedding in an "accordion-type" fold along the edges or down the middle when the bed is being made. The wing-panels along the sides and foot of the bedding provide a means of tucking the bedding further under the mattress. DiAddario does not discuss the need for greater surface area of the bedding at the head-end than the foot, nor does he provide a means for achieving or acquiring more surface area. U.S. Pat. No. 4,903,360 to Aviyam Friedman discloses top-bedding having a pleat running across the bed, parallel to the head and foot edges. The purpose of this pleat is to provide additional fabric for the user's feet. Thus, Friedman solves the relatively minor problem of restricted room for a sleeper's feet, while ignoring the major problem of sleepers competing for more cover at the head end. U.S. Pat. No. 4,304,018 to Paule McClam provides a more complex approach that comprises a sleeping-bag like arrangement that is attached to the mattress by extension flaps and that has accordion-folds along the sides. A plurality of zippers is provided along both sides and the foot of the bedding for opening and closing the accordion-folds. McClam's attempts to resolve the problems identified above are laudable, but the complexity of manufacturing and using the bedding render this solution less than optimal. U.S. patent, #768,119, to M. H. Fine is illustrative of early (1904) attempts to resolve problems closely associated to the ones identified above. In the early part of the $20^{th}$ century beds often were one-piece sofa-like structures without separable mattresses or box springs; hence, there was no means for securing bedding by tucking it in. FIG. 5 of Fine shows such a bed. Fine invented a bedspread with weights along the edges to help hold the bedspread in place, whether it be used on a sofa-like bed or by soldiers or campers sleeping on the ground. Fine also discloses a small pouch at the head-end of the bedspread to accommodate the sleeper's shoulder and neck area.

BRIEF SUMMARY OF THE INVENTION

The present invention is an article of top-bedding that provides substantially greater surface area at the head end than at the foot end, and yet it is easily folded into a neat and tidy conformation when not in use, said neat and tidy conformation being maintained by means of judiciously placed snaps or other fasteners.

A first object of the invention is to provide top-bedding that expands to accommodate sleeping partners.

A second object of the invention is to provide top-bedding that obviates the need or tendency for one person to usurp a disproportional share of the top-bedding.

A third object of the invention is to provide top-bedding, the edges of which remain tucked in during the night despite rolling and tossing, thereby prohibiting drafts from reaching the users.

A fourth object of the invention is to provide top-bedding incorporating fastening means for holding the top-bedding in a neat and tidy conformation when the bed is not in use.

The foregoing objectives are met by the present invention by providing top-bedding that has a head-end delimited by a head-end edge; a foot-end opposite the head-end, the foot-end delimited by a foot-end edge substantially parallel to the head-end edge; at least one pair of opposing sides delimited by side-edges; a first head-end corner and a second head-end corner; and a reversible expansion means for reversibly converting the top-bedding from a closed configuration to an open configuration, the closed configuration being approximately rectangular, and the open configuration having the shape of an irregular, simple polygon, whereby the distance between the first head-end corner and the second head-end corner is greater when the top-bedding is in the open configuration than when it is in the closed configuration.

BRIEF DESCRIPTION OF THE DRAWINGS

The elements of the invention and their structural and functional relationships may be easily comprehended by referring to the figures. In the drawings identical reference numbers are employed to identify identical elements. The sizes and relative positions of the elements in the drawings are not necessarily to scale. For example, thicknesses are not drawn to scale and are enlarged to insure comprehension of the drawings.

DETAILED DESCRIPTION OF THE INVENTION

The inventive concepts and novel features of the invention are described herein with reference to a specific embodiment of the invention, which is the best mode known to us for making and using the invention. This preferred embodiment is represented by the example of a top-sheet. However, it is to be understood that a top-sheet is chosen as but one example of top-bedding that exhibits the features and elements of the invention.

1. Structural Features

Figure 1:
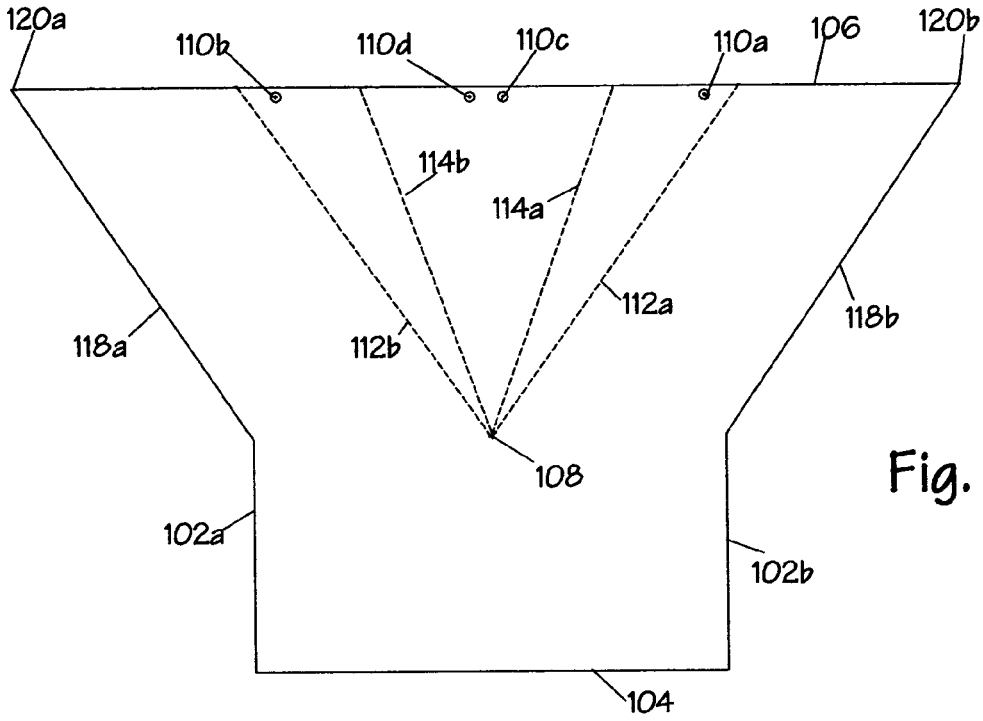
FIG. 1 is a top view of the invention in the open configuration.

The features and elements of the preferred embodiment may be appreciated by viewing FIG. 1, which is a view of the upper surface of the invention in an open configuration, the "upper surface" being defined in the conventional sense as the surface not in contact with the bed when the bedding is affixed to the bed.

The open configuration of the embodiment shown in FIG. 1 forms a convex hexagon having a head-end delimited by a head-end edge 106 with its termini at corners 120*a* and 120*b*; a foot-end delimited by a foot-end edge 104, which is approximately parallel to head-end edge 106; a first pair of opposing sides 102*a*/102*b*; and a second pair of opposing sides 118*a*/118*b*. The internal angles formed by the intersection of side 102*a* with 118*a* and by the intersection of side 102*b* with 118*b* are approximately equal to one another and greater than 180°. Side-edges 118*a* and 118*b* are skewed, but side-edges 102*a* and 102*b* may be parallel, or approximately so.

The intersection of side-edge 118*a* with the left terminus of head-end edge 106 produces head-end corner 120*a*. The intersection of side-edge 118*b* with right terminus of head-end edge 106 produces head-end corner 120*b*.

This convex hexagon can be easily cut from a single piece of suitable fabric, which is a primary reason for considering this embodiment the best mode. The type of fabric to be used is dictated by the type of top-bedding to be produced. For a top-sheet, linen, satin, silk, or light cotton are preferred. For a blanket, wool or heavy cotton are preferred. Combinations of fabrics and materials may also be used, such as insulating batting and cotton quilted together to make a quilt or duvet. The invention is not limited by the nature or type of fabric to be used.

When the invention is in the open configuration as shown in FIG. 1 it lies flat, and no folds are evident. Fold-lines 112*a*, 112*b*, 114*a*, and 114*b* are indicated in the figure so that the reader may easily comprehend how the invention is used, as discussed in the following section. These fold-lines converge at vertex 108.

Two pairs of snaps are provided for holding the invention in the closed configuration: 110*a* mates with 110*c*, and 110*b* mates with 110*d*. As FIG. 1 shows the invention in the open configuration, these snaps are not engaged.

Figure 2:
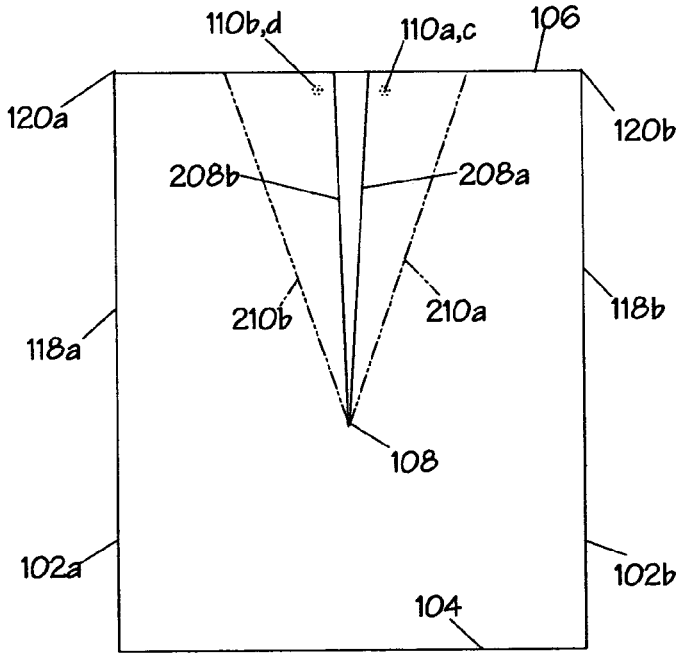
FIG. 2 is a top view of the invention in the closed configuration.

In FIG. 2. the upper surface of the top-sheet is shown in a closed configuration. To achieve this configuration the head-end has been folded along fold-lines 112*a*, 114*a*, 112*b*, and 114*b* (FIG. 1) to produce a plurality of reversible pleats, described below. By "reversible pleats" what is meant is that the pleats can be opened (unfolded) and closed (re-folded) in order to effectuate reversible expansion of the head-end edge. The geometrical effect of closing the pleats is to convert the convex hexagon of FIG. 1 to the rectangle of FIG. 2, which is how the upper surface of the invention appears when the bed is made, except that side-edges 102*a*, 102*b*, 118*a*, and 118*b* and foot-end edge 104 are not visible when the bed is made because these edges are tucked under the mattress as shown in the cross-section of FIG. 3.

As can been seen in comparing FIG. 1 with FIG. 2, the apparent length of the head-end edge 106 of the invention is modified in the closed configuration (FIG. 2) such that when viewed from the top surface, the head-end edge of the closed configuration appears significantly shorter as a result of the pleats made along the fold-lines. In otherwords, head-end corners 120*a* and 120*b* are closer together in the closed configuration than in the open configuration, the excess length of edge 106 being taken up by the reversible pleats.

It will also be noted that the convex angle between the four sides of FIG. 1 is essentially eliminated in the closed configuration of FIG. 2 such that side-edges 102*b*/118*b* and 102*a*/118*a* now appear to be reduced to two opposing, essentially straight and substantially parallel sides. These modifications mean that when attached to a mattress in the closed configuration, the invention conforms to the mattress by presenting a substantially rectangular outline with the head-end edge parallel and substantially equal in length to the foot-end edge, and the two side-edges substantially equal in length and parallel to each other.

When in the closed configuration shown in FIG. 2., two external pleats 208*a* and 208*b* form a flute or groove running longitudinally from head-end edge 106 to vertex 108 where the external folds converge. In addition, two internal pleats 210*a* and 210*b* defining the outer extremities of the expansion means also run from head-end edge 106 to converge at vertex 108. These pleats are made by folding the sheet along the fold-lines indicated at 112*a* and 112*b* in FIG. 1. When manufacturing the top-bedding and after washing it, these folds may be goffered, but thereafter the folds easily attain the proper configuration without unnecessary bother. The relationship of these folds to each other is most easily comprehended by referring to the cross-section of FIG. 3, discussed below.

Snap-pairs 110*a,c* and 110*b,d* of FIG. 1 are engaged when the sheet is in the closed position. They are not visible from the top surface in the closed configuration, being concealed within the pleats.

2. Functional Features

The primary functional feature of the invention is that it provides a reversible expansion means integral to the head-end of the sheet whereby the sheet can be affixed tautly and neatly to a bed while not in use and then easily expanded to provide a sleeping compartment spacious enough to accommodate two persons. The manner in which the invention functions may be easily appreciated by considering FIGS. 3 and 4.

Figure 3:
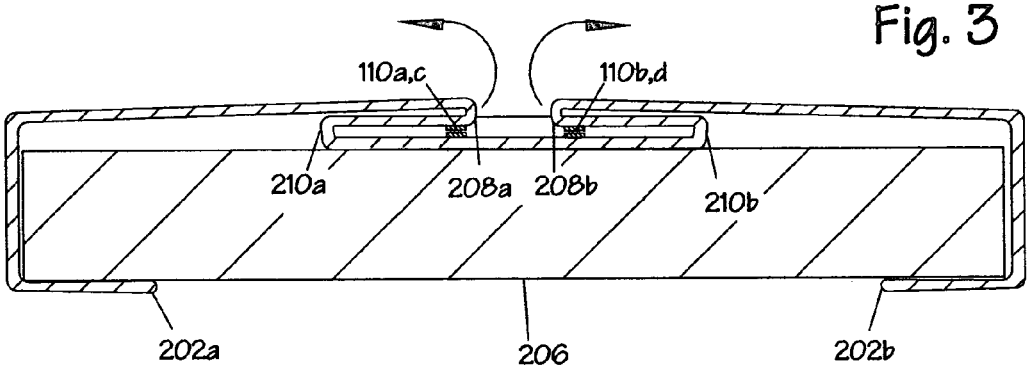
FIG. 3 is a cross-section of the invention in the closed configuration attached to a mattress.
Figure 4:
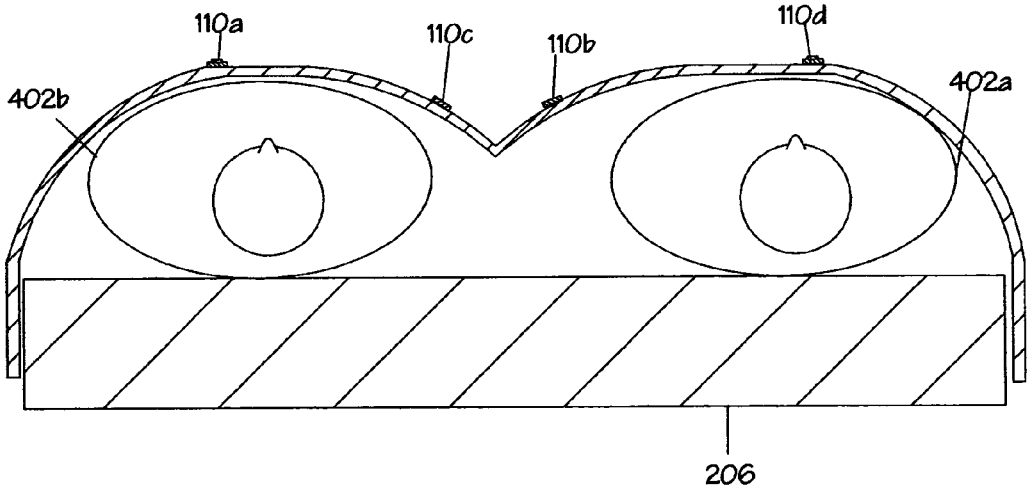
FIG. 4 is a cross-section of the invention similar to FIG. 3 but showing the invention in the open configuration and being used.

FIG. 3. and FIG. 4 are cross-sections taken of a mattress to which the invention is affixed. Other bedding such as a bottom-sheet and pillows have been deleted from FIG. 3 and FIG. 4 in order to achieve maximum clarity.

In FIG. 3 the top-bedding of invention 300 is shown in the closed configuration and attached to mattress 206, with the side-edges 202*a* and 202*b* tucked under the mattress. At or near the longitudinal center-line of the mattress are shown external folds 208*a* and 208*b*, and laterally displaced from those folds are internal folds 210*a* and 210*b*. These folds thus constitute a reversible expansion means for converting the top-bedding from a closed configuration to an open configuration. They are held in place by snap-pairs 110*b,d* and 110*a,c*.

FIG. 4 shows a cross-section of the invention 300 in the open configuration to accommodate two sleeping persons, 402*a* and 402*b*. As can be seen, snaps 110*a,c* and 110*b,d* are unfastened in order to allow the invention to expand into its open configuration, thus providing a great increase in the amount of area available for covering the sleeping persons.

In order to prepare the invention for sleeping and convert it from the closed configuration to the open configuration, one need merely pull apart the snaps, and the invention instantly and reversibly expands to accommodate the users. When one wishes to make the bed, one simply folds the invention along fold-lines 112*a*, 112*b*, 114*a*, and 114*b* (see FIG. 1), snaps the snaps closed, and tucks in the edges. The snaps, or other fastening means, allow the user to apply sufficient tension to the invention to pull it taut across the mattress 3. Details, Embellishments, and Variations a. Triangular Panel Reversible Expansion Means In the preferred embodiment disclosed above, the invention is cut into its final convex hexagonal shape of the open configuration from a single piece of fabric. The only additional manufacturing steps that are required are to hem the edges, attach the snaps or other fastening means, and goffer the folds along the fold-lines. Another way to provide the reversible expansion means is to rip or cut the fabric longitudinally from the head-end edge to a point intermediate between the head-end and the foot-end. Then one interposes into the cut or rip a triangular fabric panel having a base-edge and an opposing vertex such that the base-edge connects the ends of the head-end edge where it was ripped or cut, thereby resulting in the base-edge becoming continuous with the head-end edge, and the vertex positioned opposite the base-edge intermediate between the head-end and foot-end. The triangular panel is integrated with the top-bedding by sewing a seam along each side of the triangle thereby connecting the triangular panel to the edges created by ripping or cutting the top-bedding. Then reversible pleats are goffered along the appropriate fold-lines, originating at the base-edge and converging at the vertex.

b. Alternative Shapes of the Open Configuration

In the preferred embodiment disclosed above, the open configuration takes the shape of a convex hexagon in which the opposing side-edges 102*a*/102*b* adjacent the foot-end edge are substantially parallel to one another, but side edges 118*a*/118*b* adjacent the head-end edge are skewed. Additional types of irregular, simple polygons are suitable as shapes for the open configuration. For instance, the open configuration may be in the shape of an irregular trapezoid in which the head-end edge is parallel to the foot-end edge and the opposing sides are skewed. While this trapezoidal embodiment provides for additional top-bedding area in the foot-end, it is also more difficult to smooth the wrinkles out of the top-bedding in the foot-end area of the bed when making the bed. In our experience the convex hexagon shown in FIG. 1 is the most preferred form for the open configuration. The essential consideration in the choice of form is that in the closed configuration the shape be approximately rectangular in order to conform to the shape of the mattress, and in the open configuration the distance between corners 120*a* and 120*b* be greater than in the closed configuration.

c. Fastening Means

The preferred embodiment disclosed above incorporates fastening snaps to hold the top-bedding in the closed configuration while making the bed. It is anticipated that other fastening means are within the scope of this disclosure, including, for instance, hook-and-loop fasteners, clips, clasps, buckles, and zippers. These fastening means may be positioned along the head-end edge, as shown in the figures, and/or they may be positioned adjacent the flute formed by the closed pleats.

d. Amount of Expansion

A quantitative description of the amount or degree of expansion of the top-bedding while in the open configuration is most conveniently given by the increase in the linear measurement of the head-end edge when in the open configuration. It is our preference that this differential be approximately 124 cm.; however, a range from about 20 cm. to about 410 cm. may be used with good effect, depending upon the type of top-bedding, application, and size of the bed.

e. Position of Vertex

The longitudinal position of vertex 108 in the preferred embodiment is approximately 58% of the distance measured from the head-end edge to the foot-end edge. In a queen-sized sheet or cover, this total distance is approximately 267 cm, and the vertex lies about 155 cm. from the head-end edge. If the vertex is placed too close to the head-end edge, then the degree of expansion becomes too limited to serve the purposes of the invention. If the vertex is placed too close to the foot-end edge, then the top-bedding becomes too difficult to smooth out when making the bed. Ultimately, the best longitudinal position for the vertex depends upon the type of top- bedding, the application, and the size of the bed. Placing the vertex from about 20% to about 100% of the distance from the head end to the foot end will yield usable results.

f. Horizontal Location and the Number of the Expansion Means

The horizontal position of the reversible expansion means of the preferred embodiment is approximately coincident with the longitudinal mid-line of the mattress. However, the objectives of the invention can be achieved by having the expansion means off-set with respect to the longitudinal mid-line of the mattress; i.e. closer to one side edge than the other. The objectives of the invention can also be achieved by providing more than one expansion means. For instance, the invention contemplates embodiments in which expansion means are located on both sides of the longitudinal mid-line of the mattress.

SUMMARY OF THE ADVANTAGES OF THE INVENTION

From the description above, a number advantages of our novel top-bedding become evident:

a. It easily expands from a closed configuration to an open configuration in order to accommodate one or more users.

b. It obviates the need or tendency of sleeping partners to struggle for top-bedding because while in the open configuration it provides sufficient top-bedding for both.

c. Because there is less tugging and pulling of the top-bedding at the head-end of the bed, the edges of the top-bedding around the foot end stay tucked under the mattress, thereby preventing drafts from wafting up under the covers.

d. Making the bed is facilitated by goffered pleats which allow the top-bedding to assume its closed configuration with a minimum of trouble.

e. Once the bed is made, the fasteners hold the top-bedding in position and allow one to apply significant force to the top-bedding and pull it taut.

f. It is easily and inexpensively produced for a mass market.

From the foregoing description the novelty, utility, means of constructing, and means of using our invention will be readily apprehended. However, the foregoing description merely represents the best mode known to us as of the present date. The embodiment herein disclosed is not meant to be exclusive of other ways of making and using our invention, and it will be obvious to those of average skill in the field that other means of producing and/or using the invention lie within the scope of this disclosure and the claims, below. It is to be understood that our invention is not limited to the embodiment disclosed above but encompasses any and all embodiments within the scope of the following claims.

We claim:

1. Top-bedding comprising:

a. a head-end delimited by a head-end edge, said head-end edge having a first terminus and a second terminus;

b. a foot-end opposite said head-end, said foot-end delimited by a foot-end edge substantially parallel to said head-end edge;

c. at least one pair of opposing sides delimited by side-edges;

d. a first head-end corner formed at said first terminus of said head-end edge by the intersection of said head-end edge and one of said pair of said opposing side-edges;

e. a second head-end corner formed at said second terminus of said head-end edge by the intersection of said head-end edge and the other of said pair of said opposing side-edges; and, f. at least one reversible expansion means located at the head end reversibly converting said top-bedding from a closed configuration to an open configuration, wherein said reversible expansion means comprises a plurality of reversible pleats such that the closed configuration is approximately rectangular and the open configuration has the shape of an irregular, simple polygon wherein the distance between said first head-end corner and said second head-end corner is greater when said top-bedding is in the open configuration than when said top-bedding is in the closed configuration.

2. The top-bedding of claim 1 wherein at least two of said reversible pleats originate at said head-end edge and converge at a vertex, thereby forming at least one flute running from said head-end edge to said vertex.

3. The top-bedding of claim 1 wherein said irregular, simple polygon is a convex hexagon in which said head-end edge and said foot-end edge are substantially parallel to one another, and wherein the members of at least one pair of said opposing side-edges are skewed.

4. The top-bedding of claim 1 wherein said irregular polygon is an irregular trapezoid wherein said head-end edge and said foot-end edge are substantially parallel to one another and wherein said opposing side-edges are skewed.

5. The top-bedding of claim 1 wherein said expansion means comprises at least one triangular fabric panel integrated into said top-bedding, said triangular fabric panel having:

a. a vertex positioned intermediate said head-end edge and said foot-end edge;

b. a base-edge continuous with said head-end edge; and c. a plurality of reversible pleats originating at said base-edge and converging at said vertex.

6. The top-bedding of claim 1 further comprising reversible fastening means for maintaining said top-bedding in the closed position.

7. The top-bedding of claim 6 wherein said reversible fastening means are attached adjacent said head-end edge.

8. The top-bedding of claim 6 wherein said reversible fastening means are chosen from the group consisting of snaps, buckles, zippers, hook-and-loop fasteners, clasps, and clips.

9. The top-bedding of claim 1 wherein the horizontal location of at least one of said reversible expansion means is approximately coincident with the longitudinal mid-line of a mattress to which said top-bedding is attached.

10. The top-bedding of claim 1 wherein the horizontal location of at least one of said reversible expansion means is off-set from the longitudinal mid-line of a mattress to which said top-bedding is attached.

11. The top-bedding of claim 1 wherein said reversible expansion means is integral to said head-end.

12. The top-bedding of claim 11 wherein at least two of said reversible pleats originate at said head-end edge and converge at a vertex, thereby forming at least one flute running from said head-end edge to said vertex.

* * * * *

UNITED STATES PATENT AND TRADEMARK OFFICE

CERTIFICATE OF CORRECTION

PATENT NO. : 6,968,582 B1 
DATED : November 29, 2005
INVENTOR(S) : Stephen Barton, James Slaughter and Charles Jordan It is certified that error appears in the above-identified patent and that said Letters Patent is hereby corrected as shown below:

Column 7,
Line 56, change "head end reversibly" to -- head-end for reversibly --.

Signed and Sealed this

Twenty-fourth Day of January, 2006

JON W. DUDAS
*Director of the United States Patent and Trademark Office*